US005195692A

United States Patent [19]

Fujii et al.

[11] Patent Number: 5,195,692

[45] Date of Patent: Mar. 23, 1993

[54] AMORPHOUS RIBBON TAKE-UP METHOD AND APPARATUS THEREFOR

[75] Inventors: Hiroyuki Fujii; Masaaki Tanahashi, both of Saitama; Yukio Yoshimura, Matsue, all of Japan

[73] Assignee: Hitachi Metal, Ltd., Tokyo, Japan

[21] Appl. No.: 670,851

[22] Filed: Mar. 18, 1991

[30] Foreign Application Priority Data

Apr. 5, 1990 [JP] Japan ..... 2-91006
Apr. 5, 1990 [JP] Japan ..... 2-91007
Sep. 12, 1990 [JP] Japan ..... 2-242045

[51] Int. Cl.[5] ..... B21C 47/02
[52] U.S. Cl. ..... 242/78.1
[58] Field of Search ..... 242/56 R, 74, 78, 78.1, 242/78.3, 78.8, 25 R, 25 A

[56] References Cited

U.S. PATENT DOCUMENTS 3,503,568 3/1970 Galley ..... 242/74
3,567,149 3/1971 Williamson ..... 242/78.1
3,901,456 8/1975 Prodier ..... 242/18 A
4,116,394 9/1978 Smith et al. ..... 242/25 R
4,164,331 8/1979 Henrich ..... 242/25 R
4,557,423 12/1985 Zingler ..... 242/25 R
4,669,679 6/1987 Pali ..... 242/25 A X
5,004,172 4/1991 Tahahashi et al. ..... 242/74 X

FOREIGN PATENT DOCUMENTS 56-28166 3/1981 Japan .
56-99054 8/1981 Japan .
59-94525 5/1984 Japan .
62-127145 6/1987 Japan .
62-151251 7/1987 Japan .
63-72451 4/1988 Japan .
63-30264 6/1988 Japan .
117785 4/1989 Japan .
2101977 1/1983 United Kingdom ..... 242/78

*Primary Examiner*—Daniel P. Stodola
*Assistant Examiner*—John P. Darling
*Attorney, Agent, or Firm*—Sughrue, Mion, Zinn, Macpeak & Seas

[57] ABSTRACT

A method of taking up the ribbon, which flies from a quickly cooling roll, directly on a drum. There are connected in the recited order a guide tube fixed in the vicinity of the roll and in a tangential direction, a movable suction tube, a flexible hose and suction means. The drum is given a self-adhesive layer on its outer circumference and is movably disposed in the vicinity of the connection between the guide tube and the suction tube. While the suction tube is communicating with the guide tube, the ribbon is caused to pass through the guide tube, the suction tube and the hose. The suction tube is moved apart from the guide tube to expose the ribbon to the outside. The drum rotated in the same direction as that of the roll is moved to come into contact with the exposed ribbon. The suction tube is then moved so that the exposed ribbon passing to the suction tube may be wound on the drum.

15 Claims, 3 Drawing Sheets

AMORPHOUS RIBBON TAKE-UP METHOD AND APPARATUS THEREFOR

BACKGROUND OF THE INVENTION

1. Field of the Invention

The present invention relates to a method for taking up the amorphous ribbon, which was quickly cooled and solidified from molten metal by means of a cooling roll and was shaped, and an apparatus therefor.

2. Description of the Prior Art

The amorphous ribbon is shaped at a rate of 20 to 40 m/sec. to have a width of 5 to 25 mm and a thickness of 10 to 30 μm. This ribbon is generally called the "narrow ribbon" and is seriously fragile to shocks or torsions. The leading end of the ribbon, that was shaped at first, has an ununiform section and is disused, and this disused portion has an unfixed path of fly from the roll. The normal portion to be used and to come after the disused portion has such a large amplitude in the path of fly that it pulsates. This makes it difficult to take up the ribbon while the same is being shaped. Since, however, it omits or spares the time periods for the subsequent steps to take up the ribbon immediately shaped, there have been conceived and disclosed a number of take-up methods and apparatus therefor.

In Japanese Patent Publication No. 56-99054, a suction port, a guide tube and take-up means are arranged in the recited order so that the ribbon may be guided by a gas flow having a higher velocity than its shaping rate. Concerning the take-up means, the guidance to the take-up position and the combination of components, however, there is no substantial disclosure for practicing the method or apparatus. Especially, the disused portion of the ribbon will go out of control and will fly at first to induce troubles such as the clogging, breakage and/or disordered take-up, but there is no disclosure on the means for solving those troubles. In short, the means before and after the instant, at which the ribbon is brought into contact with the drum, are the most important for satisfying the take-up. In Japanese Patent Publication No. 56-28166, on the other hand, the rotational speed of the take-up reel is made smaller by about 2% than that of the cooling surface of the roll, so that no substantial tension is applied to the ribbon. In the foregoing Japanese Patent Publication No. 56-99054, on the contrary, a tension is applied to the ribbon, but no substantially effective disclosure is made on the flow velocity.

The guidance into the drum by sucking the ribbon is disclosed in Japanese Patent Publication Nos. 62-127145 and 62-151251. According to these two, the flown ribbon is sucked directly to a sucker till it is guided to the vicinity of the drum. If the flown ribbon is thus directly sucked and guided, the shocks due to the fly pulsations of the ribbon and the guiding shocks for correcting the path of the ribbon are involved. That is, if the flying ribbon is directly captured so that it may be corrected in the flying direction, the shocks are multiplied to break the ribbon.

In Japanese Patent Publication No. 63-72451, the ribbon is tensed after it has passed through a guide groove by means of a clamping roller, and the guide groove is then taken away to push the tensed ribbon onto the drum. Since the guide groove is provided to capture the ribbon on the roller to push it onto the drum, serious shocks are caused when the pusher comes into contact with the ribbon. The ribbon would be broken unless it is effected tension and movement without any contact.

The drum for taking up the ribbon is disclosed in Japanese Patent Publication No. Hei 01-17785. Here the drum which can swing in the vicinity of the roll is equipped with a magnet or suction port and is given a lower circumferential velocity than that of the roll so that it may take up the ribbon directly from the roll. The purpose to form the drum to be able to swing is not to make the drum come into contact with the ribbon but to adjust the winding diameter of the ribbon. In Japanese Patent Publication No. 59-94525, there is disclosed another drum which has an adhesive and which can swing.

The substantial take-up of the ribbon involves a variety of components, and it is very difficult to determine the individual objects and structures of the components and the positions and order of the components to set. There has been no substantially practical disclosure on the order of components in relation to the running of the ribbon, and the relation and timing of operations of the components, namely, to deal with the disused portion of the ribbon, to fix the path of the flying ribbon without imparting the shocks to the ribbon, to cause the drum to contact with the ribbon thereby to start the taking-up. According to Japanese Patent Publication No. 63-30264, the ribbon is guided by means of moving clamp rollers and is wound on the drum. This disclosure has many factors for breaking the ribbon because of the rotational speed and moving velocity of the clamp rollers which are adjusted to the shaping rate of the ribbon, because the ribbon is guided with contact, and because the ribbon is tensely supported at a large interval.

The ribbon is shaped at a high rate and gets seriously fragile, and its leading end shaped at first has an ununiform section, so that its flying path is unfixed to have a large amplitude. This in turn adversely affects the guidance and the winding. The reliable guidance and cutting of the disused portion has to be satisfied compatibly with the prevention of the normal portion from being undesirably broken. Thus, it is necessary to solve the contradiction between the correct cutting and the undesirable breakage while the ribbon is being moved continuously at a high speed. As has been described hereinbefore, however, there is no consistent disclosure on the guidance of the ribbon out of contact, the dealing of the disused portion, the order of bringing the drum into contact with the ribbon, and so on.

SUMMARY OF THE INVENTION

Thus, the take-up apparatus is composed of the various components and cannot be substantially practiced before the components are properly ordered. We have tried the various components on the method of and structure for taking up the ribbon and found out a method capable of substantially satisfying the take-up such as the assembly, positions and order of the components to be arranged.

It is, therefore, an object of the present invention to provide a method of and an apparatus for substantially taking up a narrow ribbon which has been the most difficult to take up.

According to a feature of the present invention, there is provided an amorphous ribbon take-up method of taking up an amorphous ribbon, which is solidified to fly by means of a cooling roll, on a rotationally driven drum having a self-adhesive layer on its outer circumference, which method comprises: the step of passing said ribbon through both a guide tube, which is arranged in the vicinity of said roll and in a tangential direction to said roll, and a suction tube, which is connected to suction means, by connecting said guide tube and said suction tube; the step of exposing said ribbon to the outside by moving said suction tube apart from said guide tube; the step of bringing said drum into abutment against said exposed ribbon; and the step of moving said suction tube to wind said ribbon on said drum.

According to another feature of the present invention, there is provided an amorphous ribbon take-up apparatus for taking up an amorphous ribbon, which is solidified to fly by means of a cooling roll, on a rotationally driven drum having a self-adhesive layer on its outer circumference, which apparatus comprises: a guide tube arranged in the vicinity of said roll and in a tangential direction to said roll; a suction tube adapted to be moved in a direction perpendicular to the axis of said roll so that it can be connected with and brought apart from said guide tube; suction means connected to said suction tube; and a rotationally driven drum having a self-adhesive layer on its outer circumference and arranged in the vicinity of the connection between said guide tube and said suction tube such that it can be moved in a direction perpendicular to the axis of said roll.

BRIEF DESCRIPTION OF THE DRAWINGS

Other objects, features and advantages of the present invention will be described in the following with reference to the accompanying drawings, in which.

DETAILED DESCRIPTION OF THE PREFERRED EMBODIMENT

The present invention will be described in the following in connection with the embodiment thereof with reference to FIGS. 1 to 8.

Figure 1:
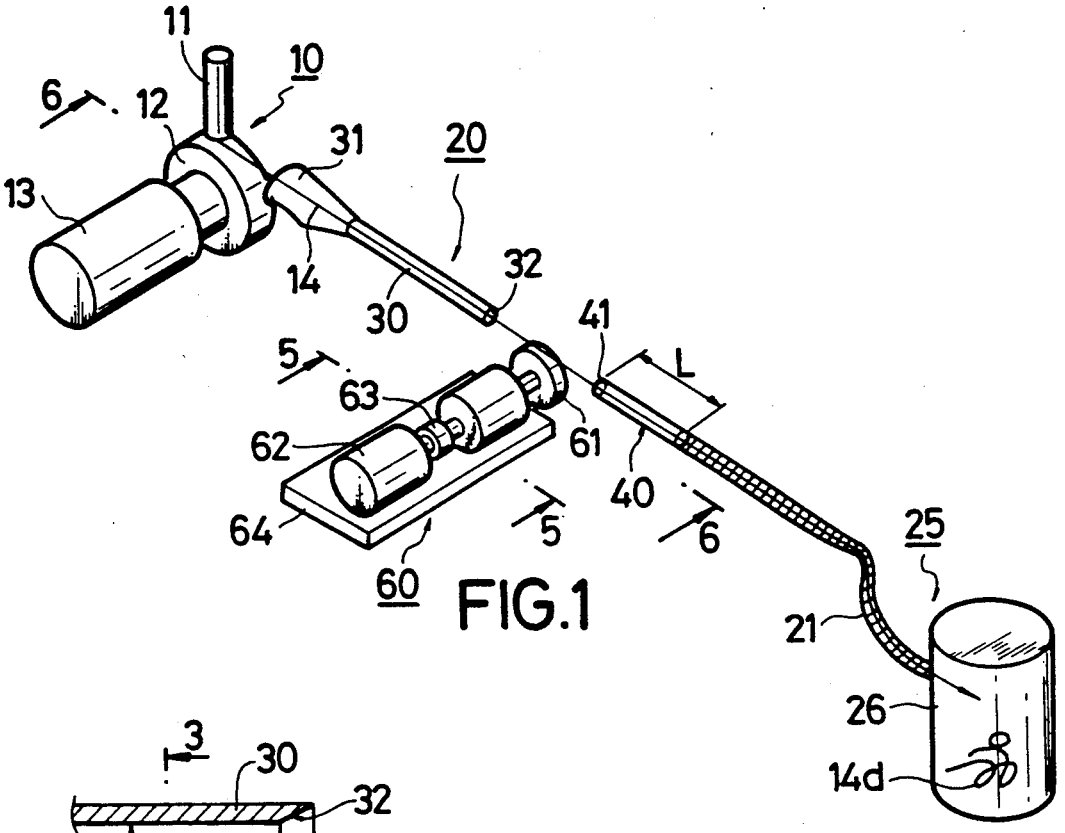
FIG. 1 is a perspective view showing the summary for carrying out the present invention.

FIG. 1 is a perspective view showing one embodiment of the present invention. An apparatus, as generally designated at 10, for making an amorphous ribbon (as will be shortly referred to as the "ribbon") is composed of a nozzle 11 for injecting molten metal and a cooling roll 12 rotated at a high speed by rotational drive means 13. The apparatus 10 thus composed quickly cools and solidifies the molten metal, which is injected onto the outer circumference of the roll 12, to shape it into a ribbon 14. The ribbon 14 thus shaped is flows at a speed of 20 to 40 m/sec. from the outer circumference of the roll 12. The ribbon 14 has a width of 5 to 25 mm and a thickness of 10 to 30 $\mu$ m, and is generally called the "narrow ribbon".

Take-up means is composed of a conduit 20, suction means 25 and drum means 60, to take up the ribbon 14 passing in the conduit 20 on a drum 61 of the rum means 60. The conduit 20 is composed of a guide tube 30 having a capture port 31 at its leading end, a suction pipe 40 having a connector 41, and a flexible hose 21, and is disposed to communicate with a tank 26 functioning as the suction means 25. The drum means 60 connects the drum 61 and a motor 62 through a hysteresis clutch 63 and is mounted on a movable base 64.

Figure 2:
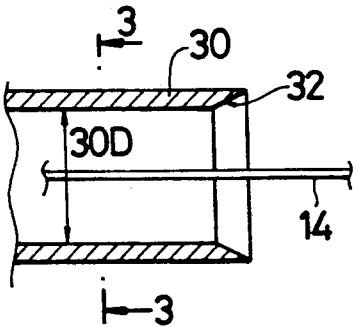
FIG. 2 is a section showing the other end of a guide tube 30.
Figure 3:
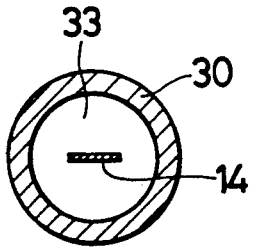
FIG. 3 is a section taken along line 3—3 of FIG. 2.

The guide tube 30 is equipped at its leading end with the capture port 31 which is formed tapered and cut obliquely, and is disposed in the vicinity of the roll 12 and in the downward tangential direction with respect to the outer circumference of the roll 12. FIG. 2 shows the other end of the guide tube 30, which has a connecting face 32 diverging from the internal diameter 30D. FIG. 3 is a section 3—3 taken from FIG. 2 and shows the relation between the guide tube 30 and the ribbon 14 passing through the guide tube 30. The guide tube 30 may have a circular or rectangular inside 33, but has its internal diameter 30D set 1.5 to 8.0 times as large as the width of the ribbon 14 and its length set 5 to 25 times as long as the internal diameter 30D. With these internal diameter and length thus set, the ribbon 14 can have its amplitude controlled by the flow of air to pass the ribbon 14 out of contact.

Figure 4:
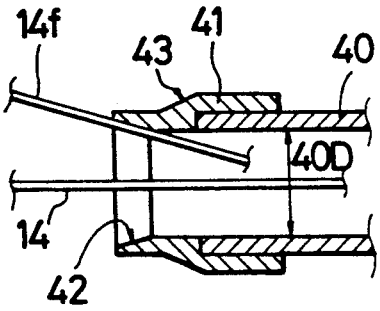
FIG. 4 is a detailed section showing the connector 41 of a suction tube 40.
Figure 6A:
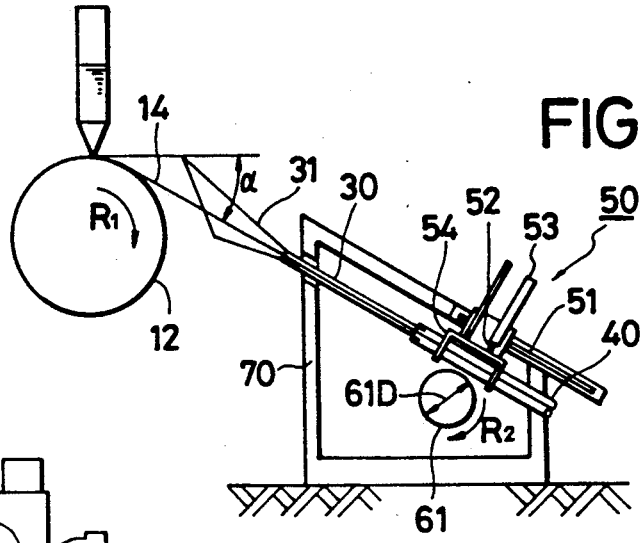
FIGS. 6(*a*), 6(*b*), 6(*c*) and 6(*d*) are elevations taken along line 6—6 of FIG. 1 and show the moving states of the suction tube 40 and a drum 61 mainly.

The suction tube 40 has its internal diameter 40D set 1.1 to 6.0 times as large as the width of the ribbon 14 and its length set 10 to 50 times as long as the internal diameter 40D. FIG. 4 shows the connector 41 of the suction tube 40. This connector 41 has its minimum internal diameter set as large as the internal diameter 40D of the suction tube 40 and has a face 42 diverging from the internal diameter. The connector 41 is formed on its outer circumference with a connecting face 43 to be fitted in the connecting face 32 of the guide tube 30, so that it may be brought into and out of tight contact with the guide tube 30. The ribbon 14 in the guide tube 30 passes near the center generally along the axis but may come into contact with the face 42 of the connector 41, as indicated at 14*f*, in dependence upon the leaving movement of the suction tube 40. Therefore, the face 42 may desirably be made of a hard metal, ceramics or glass. In order to further cool the ribbon 14, the connector 41 is surrounded by a cooling area which is equipped with water- or air-cooling means.

Figure 5:
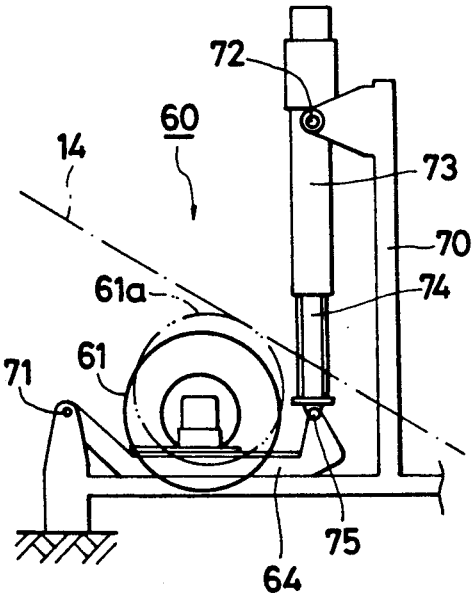
FIG. 5 is a detailed elevation taken along line 5—5 of FIG. 1 and shows a base 64.
Figure 6B:
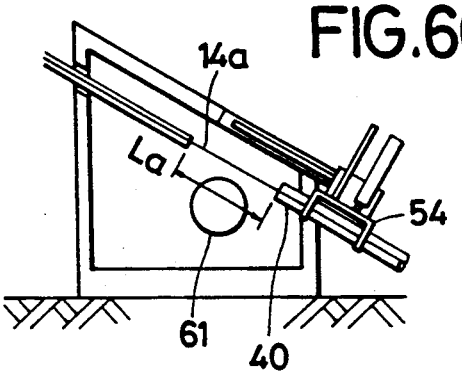
Figure 6C:
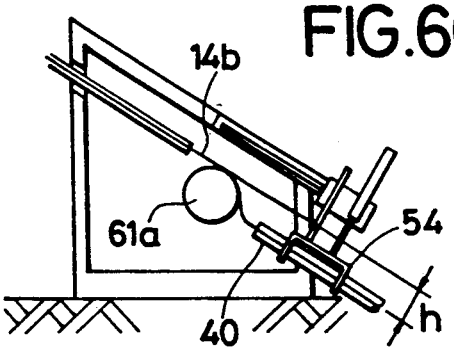
Figure 6D:
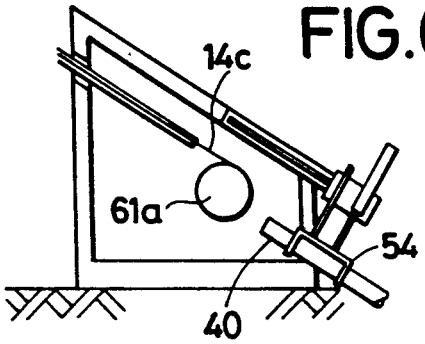
Figure 7:
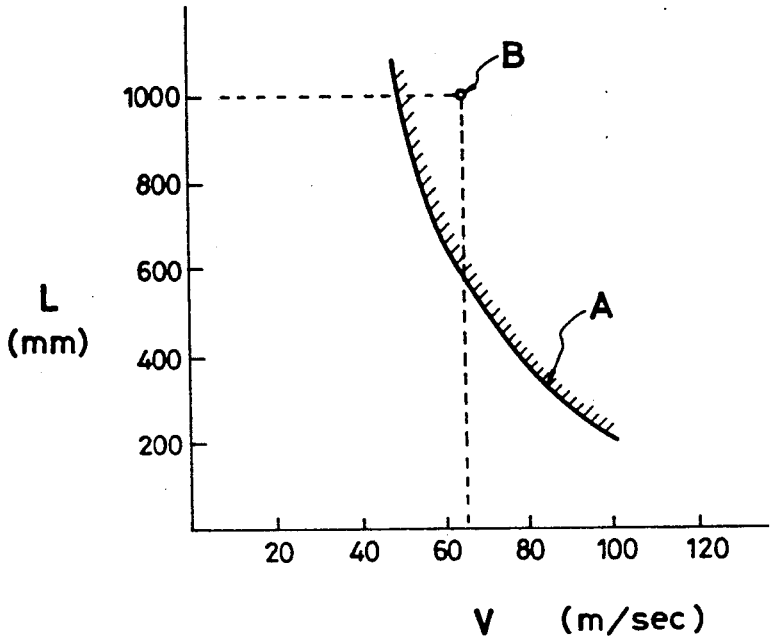
FIG. 7 is a graph plotting the relation between the length of the suction tube 40 and the relative velocity.

FIG. 5 exemplifies the movable base 64 of the drum means 60. The base 64 has its one end attached to a frame 70 through a pin 71. To the frame 70, on the other hand, there is attached through a pin 72 a cylinder 73 having a piston 74, to which is attached the other end of the base 64 through a pin 75. In other words, the drum 61 is enabled to come into contact with the ribbon 14 passing near the drum 61 so that it can move to a position indicated at 61*a*. The motions of the drum 61 may be rocking or rectilinear ones, and can meet the present invention if they come into contact with the ribbon 14.

FIGS. 6(*a*) to 6(*d*) show the moving states of the suction tube 40 and the drum 61, as will be individually described in the following. FIG. 6(*a*) shows the initial state of the operations, in which the rotational direction R1 of the roll 12 and the rotational direction R2 of the drum 61 are identical and in which the guide tube 30 and the suction tube 40 are connected in tight contact with each other so that the air is sucked from the capture port 31 via the hose 21 by the tank 26. The guide tube 30 fixed on the frame 70 is positioned so straight as to have its angle $\alpha$ of depression at 20 to 90 degrees with respect to the horizon, thereby to capture the leading end 14*a* of the ribbon 14 flying from the roll 12 by the capture port 31 directed toward the roll 12. The angle $\alpha$ may desirably be made variable because the flying state is different depending upon the size of the ribbon 14, and the number of revolution and the state of the outer circumference of the roll 12.

The ribbon 14 passing through the guide tube 30 is vibrated under a tension F by the suction of the tank 26. This tension F is proportional to both the frictional force, which is established by the relative velocity (V2−V1) between the velocity V1 of the ribbon 14 and the flow velocity V2 of the air in the tube, and the length L of the conduit exerting influences upon the frictional force, as defined by the following formula:

$$F=K\times(V2-V1)\times L,$$

wherein

K is a constant depending upon the width and thickness of the ribbon.

Since the present invention is applied mainly to the narrow ribbon, the optimum tension F is 1 to 4 $Kg/mm^2$. For example, the zone, in which the tension F is equal to or higher than 1 $Kgf/mm^2$ for the length L of the suction tube 40 and the relative velocity $V=V2-V1$, is hatched, as indicated at A. In this zone, a tension no less than 1 $Kgf/mm^2\times 20\ \mu m\times 5\ mm=100$ gf is applied to the ribbon 14 in case the ribbon 14 has a thickness of 20 $\mu$m and a width of 5 mm. In the embodiment, a point B in the graph is caused to satisfy the zone A by setting the length L at 1,000 mm and the relative velocity V at 65 m/sec. From these discussions, the diameters 30D and 40D and length of the conduit are thus set, but the flow velocity of the air in the conduit is set in the following manner. When the air flow velocity in the suction tube 40 is set 1.2 to 2.0 times as high as the circumferential velocity of the roll 12 in case the guide tube 30 and the suction tube 40 are connected, then the ribbon 14 has its torsions, vibrations and pulsations reduced so drastically that it is not broken in the least.

Moving means 50 for the suction tube 40 shown in FIG. 6(*a*) is constructed by mounting a cylinder 51 on the frame 70, by attaching a bracket 52 movably on the moving rod of the cylinder 51, by mounting a carriage 54 on the bracket 52 through a cylinder 53, and by fixing the suction tube 40 on the carriage 54. FIG. 6(*b*) shows the state, in which the suction tube 40 is moved to the outside by a length La from the guide tube 30 by the cylinder 51 while the ribbon is passing, as indicated at 14*a*. This length La of exposure is within a range exceeding the external diameter 61D of the drum 61 but not its two times, and the flow velocity of air in the suction tube 40 at this time is 1.5 to 3.5 times as high as the circumferential velocity of the roll 12.

FIG. 6(*c*) shows the movement of the drum 61 and the secondary movement of the suction tube 40. The drum 61 is brought into contact with the exposed ribbon 14*a* so that it comes into the state indicated at 61*a* whereas the ribbon comes into the state indicated at 14*b*. Simultaneously with these movements, the suction tube 40 is moved to wind the ribbon on the drum 61 by the action of the cylinder 53. Specifically, the ribbon is wound as a result of parallel movement of a distance h from the primary position of movement of the suction tube 40. Alternatively, the suction tube 40 itself may be so secondarily moved in an arcuate locus as to wind the ribbon on the drum 61.

FIG. 6(*d*) shows the state of starting the winding operation. At this time, the drum 61*a* is rotated at a circumferential velocity higher by 0.1 to 1.5% than that of the roll 12. This increased velocity applies a slight tension to the ribbon 14, which is passing through the guide tube 30 while being guided to pulsate, to reduce the amplitude thereby to stabilize the path of the ribbon 14. The ribbon in the state 14*b* of FIG. 6(*c*) is cut, as it comes into contact with the drum 61*a*, until it is taken up in the state 14*c* on the drum 61*a*. That portion of the ribbon 14*a*, which is exposed at first in FIG. 6(*b*), is cut away and collected as unnecessary ones 14*d* in the tank 26 acting as the suction means 25.

Figure 8:
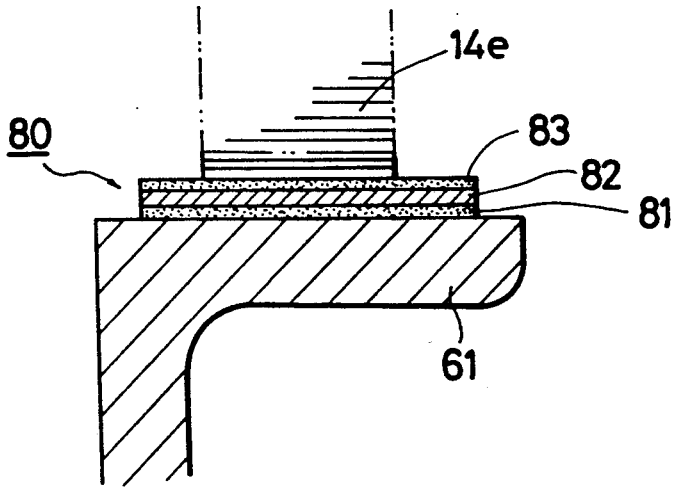
FIG. 8 is a detailed section showing a self-adhesive layer 80 of the drum 61.

FIG. 8 shows a self-adhesive layer 80 of the drum 61. This self-adhesive layer 80 is formed of three layers: an adhesive layer 81 to be adhered to the drum 61; a base 82; and an outermost adhesive layer 83. The ribbon is adhered to and laminated on the adhesive layer 83 is indicated at 14*e*. The adhesive layers 81 and 83 are made of acrylic resins or rubber and are given an adherence excellent in, a high-temperature range, e.g., an adhesion of 50 g/mm or higher at 20° C. and an adhesion of 25 g/mm or higher at 80° C. The base 82 is made of unwoven fabric, Japanese paper or a polyester film, for example, and satisfies the adhesions of the two adhesive layers 81 and 83.

Next, the operations of the present invention will be described in the following. The leading end of the ribbon 14 flown into the air from the roll 12 is the disused one and is captured by the capture port 31 while floating in the air, until it passes through the guide tube 30, the suction tube 40 and the hose 21 and reaches the tank 26 acting as the suction means 25. These tubes may be made of acrylic resins or vinyl chloride or polished ones so that they may establish less drags to the air flow. At the next stage, the suction tube 40 is moved in the passing direction of the ribbon 14 apart from the guide tube 30 thereby to expose the ribbon 14 to the outside. Then, the drum 61 is moved to contact with the exposed ribbon 14. Simultaneously with this, the suction tube 40 is moved so that the exposed ribbon 14 in its path may be wound on the drum 61. The ribbon 14 is brought into contact with the self-adhesive layer 80 of the drum 61 as a result of movements of both the suction tube 40 and the drum 61 so that it is cut away at its predetermined position. The disused ribbon 14*d* thus cut is collected in the tank 26 whereas the used ribbon is taken up in the laminated ribbon 14*e* by the drum 61.

According to the present invention, the ribbon is guided by the stationary guide tube, and the suction tube is disposed to communicate with and moved away from the guide tube, so that the drum may come into contact with the exposed ribbon passing between the guide tube and the suction tube, to wind the exposed ribbon thereon. As a result, the ribbon can be cut at its predetermined position and taken up in the laminated form. Especially, the ribbon is guided in the straight state but without any contact to reduce the pulsations so that it is broken in the least. Moreover, the ribbon has its disused portion cut away by the contact of the self-adhesive layer of the drum with the ribbon so that the regular take-up can be substantially achieved.

Although the embodiments of the present invention have been described above, various modifications are possible without departing from the spirit of the invention which is defined solely in the appended claims.

What is claimed is:

1. A method of taking up an amorphous ribbon, which is solidified to fly by means a cooling roll, on a rotationally driven drum having a self-adhesive layer on its outer circumference, comprising the steps of:

passing said ribbon through both a guide tube, which is arranged in the vicinity of said roll and in a tangential direction to said roll, and a suction tube, which is connected to suction means, by connecting said guide tube and said suction tube;

exposing a portion of said ribbon to the outside by moving said suction tube apart from said guide tube;

moving said drum in a first direction toward said exposed ribbon only until a surface of said drum first tangentially contacts said exposed portion of said ribbon; and moving said suction tube in a second direction opposite said first direction such that said exposed portion of said ribbon is partly wound around said drum.

2. The method according to claim 1, wherein the flow velocity of the air inside of said suction tube when said guide tube and said suction tube are connected is 1.2 to 2.0 times as high as the circumferential velocity of said roll.

3. The method according to claim 1, wherein the flow velocity of the air inside of said suction tube when said suction tube is moved apart from said guide tube is 1.5 to 3.5 times as high as the circumferential velocity of said roll.

4. The method according to claim 1, wherein the circumferential velocity of said drum is higher by 0.1 to 1.5% than that of said roll.

5. The method according to claim 1 wherein said moving steps attendantly cause said ribbon to be cut when said exposed portion of said ribbon contacts said self-adhesive layer of said drum as said ribbon is wound therearound.

6. An apparatus for taking up an amorphous ribbon, which is solidified to fly by means of a cooling roll, on a rotationally drive drum having a self-adhesive layer on its outer circumference, comprising:

a guide tube arranged in the vicinity of said roll and in a tangential direction to said roll;

a suction tube adapted to be moved in a direction perpendicular to the axis of said roll so that it can be connected with and separated form said guide tube to expose a portion of said ribbon;

suction means connected to said suction tube; and a rotationally drive drum having a self-adhesive layer on its outer circumference and arranged in the vicinity of the connection between said guide tube and said second tube;

first moving means for moving said drum in a first direction toward said exposed portion of said ribbon only until a surface of said drum tangentially contacts said exposed portion of said ribbon; and second means for moving said suction tube in a second direction opposite said first direction such that said exposed portion of said ribbon is partially wound around said drum.

7. The apparatus according to claim 6, wherein the velocity of said ribbon flying from said roll is 20 to 40 m/sec., and wherein said ribbon has a width of 5 to 25 mm and a thickness of 10 to 30 μm.

8. The apparatus according to claim 6, wherein said guide tube and said suction tube are linearly fitted and connected through connection means.

9. The apparatus according to claim 6, wherein said guide tube is tangentially directed at an angle of depression of 20 to 90 degrees with respect to the horizon.

10. The apparatus according to claim 6, wherein said guide tube has a path diameter 1.5 to 8.0 times as large as the width of said ribbon and a path length 5 to 25 times as large as said path diameter.

11. The apparatus according to claim 6, wherein said suction tube has a path diameter 1.1 to 6.0 times as large as the width of said ribbon and a path length 10 to 50 times as large as said path diameter.

12. The apparatus according to claim 6, wherein said suction tube is connected with said suction means through a flexible hose.

13. The apparatus according to claim 6, wherein said drum is rotationally driven through a hysteresis clutch.

14. The apparatus according to claim 6, wherein the self-adhesive layer formed on the outer circumference of said drum is made of an acrylic resin or rubber having an adherence of 50 g/mm or higher at 20° C. and 25 g/mm or higher at 80° C.

15. The apparatus according to claim 6, wherein said first and second moving means attendantly causes said ribbon to be cut when said exposed portion of said ribbon contacts said self-adhesive layer of said drum as said ribbon is wound therearound.

* * * * *